United States Patent [19]

Fitzpatrick

[11] 4,238,040

[45] Dec. 9, 1980

[54] NURSING UNIT

[75] Inventor: William E. Fitzpatrick, Wyckoff, N.J.

[73] Assignee: International Playtex, Inc., Stamford, Conn.

[21] Appl. No.: 65,260

[22] Filed: Aug. 9, 1979

[51] Int. Cl.[3] ..... A61J 9/00

[52] U.S. Cl. ..... 215/11 E; 215/274

[58] Field of Search ..... 215/11 R, 11 E, 11 C, 215/275, 274; 220/319

[56] References Cited

U.S. PATENT DOCUMENTS

| | | | |
|---|---|---|---|
| 2,624,485 | 1/1953 | Boston | 215/11 E |
| 3,075,666 | 1/1963 | Hoffstein | 215/11 E |
| 3,645,414 | 2/1972 | Barr | 215/11 E |
| 3,790,017 | 2/1974 | Fitzpatrick | 215/11 E |
| 4,044,917 | 8/1977 | Vella | 220/319 X |
| 4,089,433 | 5/1978 | Jonsson | 215/274 X |

*Primary Examiner*—Donald F. Norton

*Attorney, Agent, or Firm*—Stewart J. Fried

[57] ABSTRACT

There is disclosed a nursing unit of the type employing a liquid-retention sac disposed in a holder and a nipple, the holder being provided with an annular groove for seating the depending skirt of a snap-on type frictionally secured nipple. To adapt such a nursing unit to receive a nipple which is secured by a screw type retainer a removable threaded adaptor ring is disposed within the annular groove of the holder. The ring cooperates with a threaded nipple retainer to more securely hold the nipple and liquid-retention sac in place, thereby substantially reducing the possibility of accidental or inadvertent removal of the nipple, especially by older infants and, as well, reducing the possibility of leakage of contents from the sac. Existing nursing holders intended to secure a snap-on nipple for use with very young infants can be modified very simply with the instant adaptor ring to now receive a screw down retainer for the nipple.

13 Claims, 7 Drawing Figures

NURSING UNIT

This invention relates to improved nursing units or holders of the type used as primary supports in nursing systems utilizing collapsible liquid-retainer sacs. More particularly, the invention relates to an improved nursing holder including means to easily adapt a presently existing system to have greater resistance against accidental removal of the nipple as the nursing infant becomes older, while deliberate removal of the nipple, when desired by the parent, is facilely accomplished.

BACKGROUND OF THE INVENTION

Nursing unit arrangements of the general type described herein are known. Typically such units comprise a hollow nursing holder which is adapted at one end to receive a collapsible liquid-retention sac and a nipple. A widely known and used arrangement of this type is the unit described in U.S. Pat. No. 3,075,666 to Hoffstein. It includes a generally cylindrical nursing holder having an annular groove at one end. The groove has on one side a peripheral rim extending from the holder at substantially a right angle and, on the opposite side, a shoulder on the main body portion of the holder. Within the holder, there is disposed a collapsible liquid-retaining sac having the open end turned back and downwardly over the peripheral rim of the holder. A suitable nursing nipple which can be used with such nursing unit arrangements is described in U.S. Pat. No. 2,588,069 to Allen. It has a teat-like portion terminating in a ridge that extends outwardly in the form of a flange having a depending skirt. On the inner surface of the depending skirt an annular groove is provided. The groove is adapted to frictionally engage the peripheral rim of the nursing holder, the portion of the skirt below the groove being seated within the annular groove of the holder. Positioning of the collapsible sac on the holder causes the open end of the sac to stretch over the peripheral rim thereof and resiliently engage the surface of the annular groove of the holder. Positioning the nipple on the holder locks the open end of the sac between the holder and the nipple and the nursing holder, thereby preventing the sac from pulling loose from the holder during use.

Another nursing unit of the general type described is disclosed in U.S. Pat. No. 3,790,017 to Fitzpatrick and Cubitt. It differs from the unit of Hoffstein by providing a nursing holder in which the annular groove proximate to the nipple-receiving end of the holder has an abutment shoulder of rim. This shoulder extends from the groove a lateral distance at least equal to or greater than the thickness of the portion of the nipple which abuts thereon thus providing an arrangement wherein the possibility of accidental or inadvertent removal of the nipple by an infant is substantially reduced. At the same time, the discontinuous shoulder provides ready access by a parent to disengage or unseat the nipple with the tip of the finger or thumb by contact of the finger or thumb with that portion of the skirt of the nipple that is exposed through the discontinuity of the shoulder or rim.

A nursing system having a screw down type of nipple is also known, as disclosed in U.S. Pat. No. 2,624,485, to Boston. Such an arrangement is less likely to result in accidental dislodgment of the nipple by an older infant.

While it is convenient to use a snap-on type of nipple when the infant is young, an even greater securing force is preferable as the infant grows older and reaches the toddler stage and a nursing system employing a screw down type of nipple is more suitable. With the present invention one has the benefit and advantage of both types of systems. This is because the present invention permits extended use of the previously known holders, that is the same holders with older infants or toddlers, thus obviating the necessity of replacing them, while providing greater securing force for the nipple. On the other hand, the present invention permits relatively facile removal of the nipple from the holder by the parent when desired.

BRIEF STATEMENT OF THE INVENTION

A nursing unit according to the invention is provided with a generally elongated, hollow nursing holder. It has a collapsible liquid-retention sac with a closed end within the hollow portion of said holder. An open end extends therefrom. It also has a nipple with a teat-like protuberance. The nursing holder is provided with an annular groove proximate to the open sac and nipple receiving end which forms a rim on the side of the groove closest to the open sac and nipple receiving end and a discontinuous abutment shoulder on the opposite side of the groove. The liquid-retention sac has an upper marginal portion folded outwardly and downwardly over the rim. A split, threaded adaptor ring provided with at least one depending tab is located in the annular groove, the depending tab thereof being disposed within a discontinuity of the shoulder. The upper marginal portion of the sac is folded outwardly and downwardly over the split, threaded adaptor ring. A threaded nipple retainer is disposed over the holder and engages the split, threaded adaptor ring. The nipple is disposed in the threaded nipple retainer and secured against the rim thereby. The threaded nipple retainer cooperates with the split threaded adaptor ring to secure the marginal portion of the liquid-retention sac between the threads thereof and against the shoulder.

A nursing unit in accordance with the present invention is particular advantageous because, as previously mentioned, it permits use of existing holders, such as, for example, the holders shown in the Fitzpatrick and Cubitt patent mentioned. Existing holders need not be replaced when an infant grows older. Instead, the holders may be modified simply by employing the adaptor ring, nipple and threaded nipple retainer disclosed herein in combination therewith.

THE DRAWINGS

In order to describe the invention more fully attention is directed to the accompanying drawings which:

Figure 1:
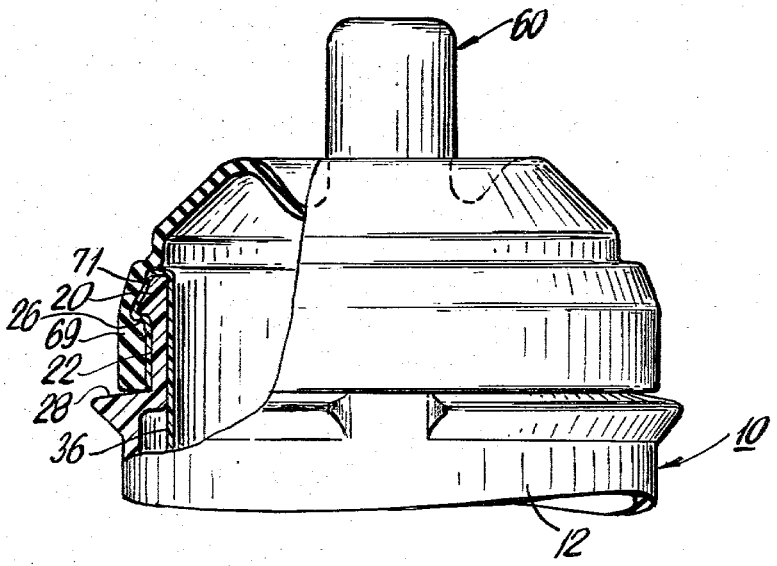
(PRIOR ART) FIG. 1
FIG. 1 is a partial sectional view in elevation of a known nursing unit to which the present invention constitutes an improvement.
Figure 2:
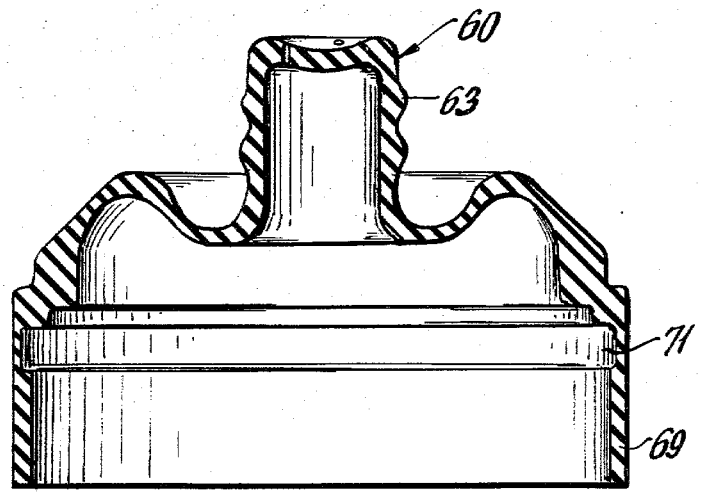
(PRIOR ART) FIG. 2
FIG. 2 is a sectional view in elevation of a prior art nipple employed in conjunction with the nursing unit system of FIG. 1.

Referring to the drawings and in particular to FIG. 1, there is illustrated there a nursing holder 10, which may be of the same construction as that described in the above-mentioned Fitzpatrick et al. patent. Nursing holder 10 comprises a substantially tubular member or body portion 12. The top marginal edge of the holder has a radially extending rim 20 and is provided with a substantially annular groove designated by 22 which defines a shoulder 26 and a discontinuous abutment shoulder 28. Nursing holder 10 is of the general type used in conjunction with a collapsible liquid retaining sac 36 and a teat-type nipple 60 of the snap-on type, as shown in FIG. 2 and such as disclosed in the above-mentioned Allen patent. As can be seen from FIGS. 1 and 2, the prior art nipples illustrated are provided with a depending skirt 69 and an internal groove 71 adapted to engage rim 20 of the holder. The depending skirt 69 has an appropriate width and depth such that the bottom portion thereof mates with the annular groove 22 of the holder 10 and lies against the abutment shoulder 28.

Description of the Preferred Embodiments

Figure 3:
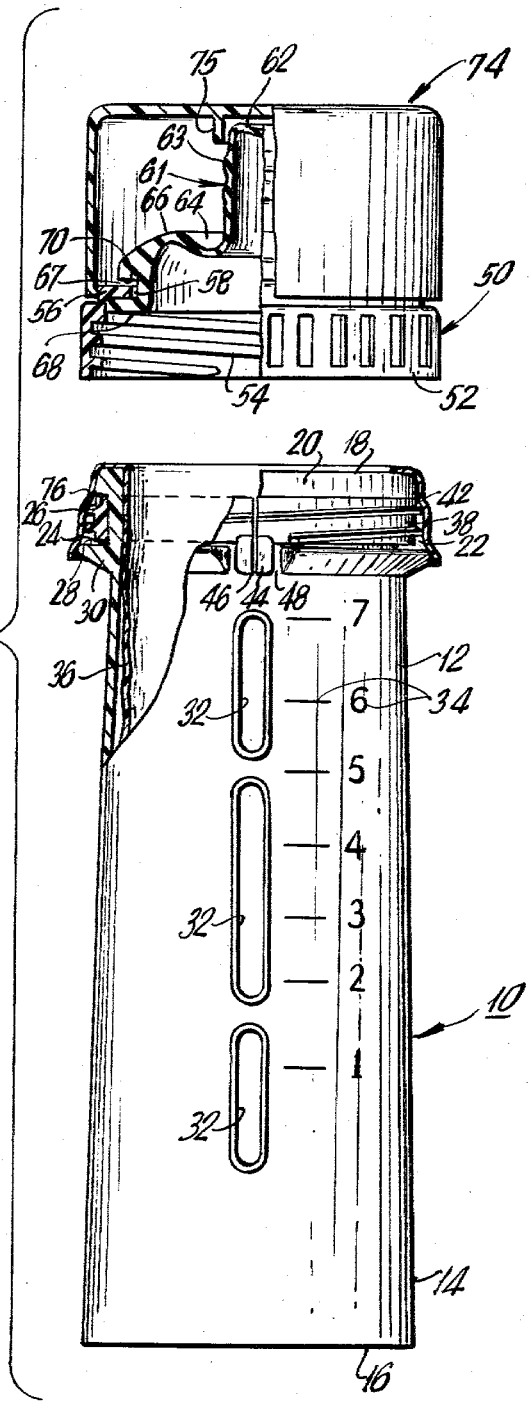
FIG. 3 is a partial sectional view in elevation of a nursing unit in accordance with the invention showing the threaded nipple retainer and cap separated from the nursing holder and the split threaded adaptor ring disposed in the annular groove of the nursing holder.

Referring now to FIG. 3, there is illustrated there a nursing holder according to the invention generally designated by the numeral 10, which may be of the same construction as the holder described. Nursing holder 10 comprises a substantially tubular member or body portion 12 having a flared skirt portion 14, and terminates in bottom and top openings 16 and 18, respectively. Nursing holder 10 is the the general type used in conjunction with a collapsible liquid-retaining sac 36, and a teat-type nipple 60, both of which will be described in greater detail hereinafter. Longitudinally positioned, elongated slots 32 are provided in the side of holder 10 adjacent to calibrated markings or other indicia 34 which may be used as a guide to indicate the amount of liquid remaining in the liquid-retaining sac disposed in holder 10. Slots 32 not only permit one to view the level of liquid in the collapsible liquid-retaining sac but, as well, when heating the liquid contents present in the sac, such as, for example, by immersion of the nursing unit in a water bath, permit contact of the bath water directly with the sac. Further when the bottom of the bottle is closed with cover 74 slots 32 permit air to enter the holder as the sac 36 colapses.

The top marginal edge of holder 10 has a radially extending rim 20. The outer surface of the top of holder 10 contains a substantially annular groove generally designated by 22, which has a substantially cylindrical surface 24. Groove 22 is defined axially by upper and lower substantially right angle shoulders that is shoulder 26 and discontinuous abutment shoulder 28, respectively. Upper right angle shoulder 26 is the lower radially extending surface of rim 20 at the top opening 18 of the holder 10 and lower right angle discontinuous abutment shoulder 28 forms a contiguous part of an annular rim 30.

The tubular holder 10 is adapted to hold a collapsible bag or liquid-retention sac 36 which may be of the general type shown in U.S. Pat. No. 3,204,855 to Boynton et al., although other similar sacs may also be employed in the nursing unit of this invention.

Figure 5:
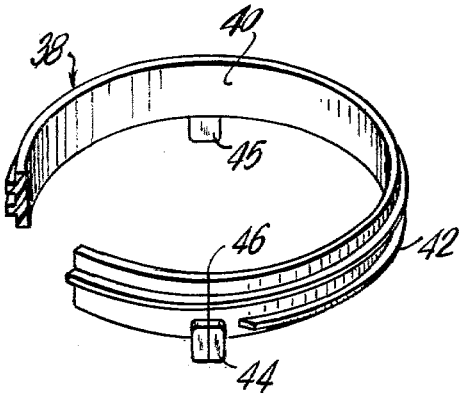
FIG. 5 is a partial view in perspective of the split threaded adaptor ring employed with the nursing unit of the invention.
Figure 7:
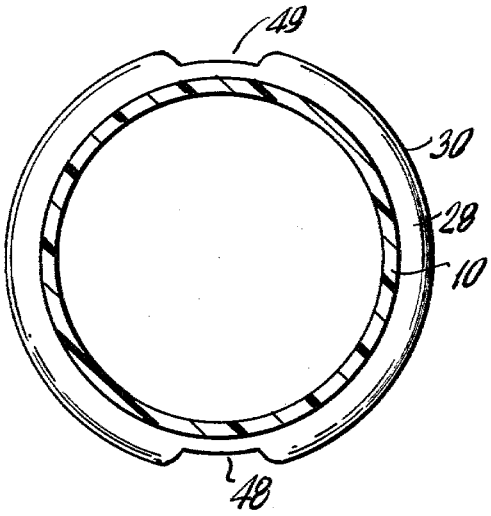
FIG. 7 is a sectional plan view taken across lines 7—7 of the nursing holder of the nursing unit illustrated in FIG. 4 and showing the discontinuous abutment shoulder in detail.

In accordance with the present invention a split threaded adaptor ring 38 is disposed within annular groove 22. Ring 38 may be fabricated from any suitable material which has structural integrity and is sufficiently flexible to be placed about the holder and, when so placed, provides a means for holding the retainer 50. It is preferably plastic, such as polyethylene, polyvinyl chloride, nylon or polyester and the like. As may be seen more particularly in FIG. 5 ring 38 has a generally circular or ring-like shaped body 40 and is provided on its outer surface with threads 42. Moreover, ring 38 is provided with at least one but preferably a plurality of depending tabs such as designated by 44 and 45 and is split preferably along a line passing through the body and one tab, as shown more particularly by numeral 46. Thus, ring 38 is separable and can be partially opened to be facilely disposed around a suitably shaped object or more particularly into and around groove 22 of holder 10 as shown in FIG. 3 with the tabs 44 and 45 being disposed in the discontinuities 48 and 49 of abutment shoulder 28 of rim 30, as shown in FIG. 7, thereby retaining the ring in groove 22 around holder 10.

Figure 4:
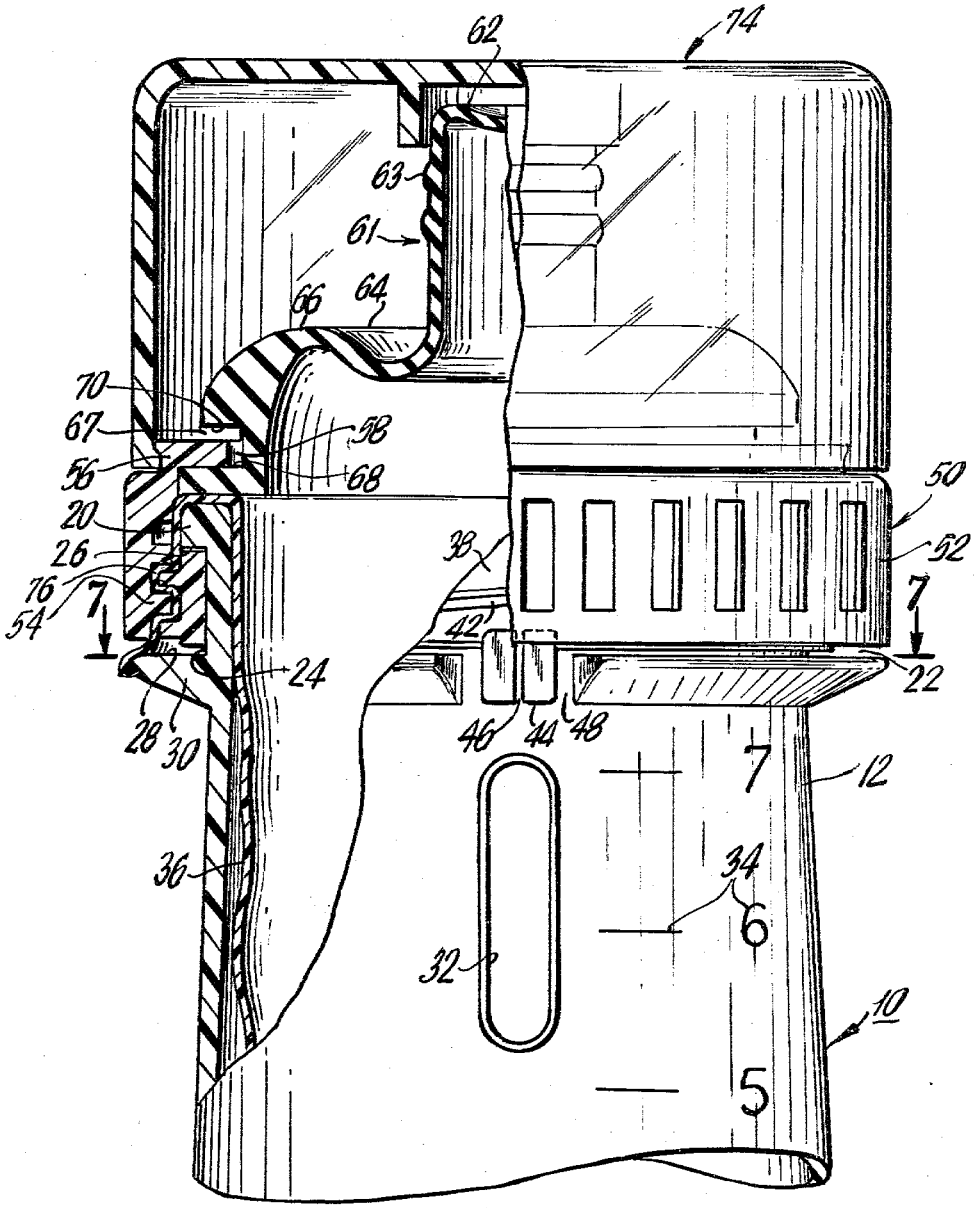
FIG. 4 is a partial view in elevation and partially in section of the nursing unit illustrated in FIG. 3 showing the threaded nipple retainer and cap assembled with the nursing holder.

A nursing unit or system in accordance with this invention also includes a threaded nipple retainer generally designated by 50 and which is of a generally circular shape and adapted to cooperate with holder 10 as illustrated more particularly in FIGS. 3 and 4. As is shown, retainer 50 comprises a downwardly depending skirt 52 which is provided on its internal surface with threads 54 adapted to cooperate with the threads of the split threaded adapter ring 38. In addition, retainer 50 is also provided with an undercut, raised, inwardly extending lip 56 which extends circumferentially around a central circular nipple receiving opening 58.

Figure 6:
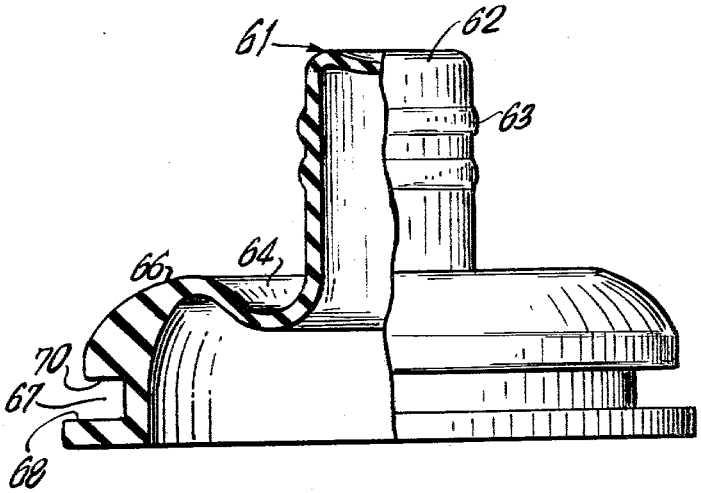
FIG. 6 is a partial sectional view in elevation showing the nipple construction in accordance with the invention.

As shown in the drawings a nursing unit in accordance with this invention also includes a nipple, generally designated by numeral 61. In contrast to the nipple 60 of FIG. 1 which has a depending skirt 69 and an internal groove 71, nipple 61, as shown in detail in FIG. 6 has a flat flange 68 and an external groove 67. More specifically, the nipple of FIG. 6 is provided with a teat-like protuberance 62 terminating in an areola portion 64 which is connected to a breast-like portion 66. The breast-like portion of nipple 61 is also provided with an external annular groove 67 defining a continuous shoulder or flat flange 68 on the side of the groove farthest away from teat-like protuberance 62 and another continuous shoulder 70 on the side of the groove nearest the teat-like protuberance. As illustrated in FIGS. 3 and 4 of the drawings, when nipple 61 is inserted in the nipple receiving opening 58 of retainer 50 the upper surface of shoulder 68 lies against the lower surface of lip 56 and the lower surface of shoulder 68 abuts and lies against rim 20 of holder 10, thus retaining the nipple in retainer 50 and force fitting or securely fastening shoulder 68 between rim 20 and lip 56 when retainer 50 is threaded onto holder 10. The lower surface of the other continuous shoulder 70 defined by groove 67 loosely abuts or lies against the upper surface of lip 56. Consequently, while shoulder 68 is relatively tightly secured, shoulder 70 being only loosely secured is able to flex thus lending a greater degree of flexibility to nipple 61, thereby more realistically emulating the flexibility and softness of the human breast.

Moreover, in accordance with the invention, the nipple may be, and preferably is, provided with a generally longer teat-like protuberance 62 in comparison to the nipple illustrated in FIG. 2. Moreover, the protuberance 62 may have a regular smooth surface as shown in FIG. 1 and in the above-mentioned Fitzpatrick and Cubitt patent but is preferably provided with a plurality of rings 63 as shown in FIG. 2 and the aforementioned Allen patent.

The nursing unit according to this invention is particularly useful when nursing older infants and toddlers, since such a nursing unit insures substantial elimination of the possibility of accidental dislodgment of the nipple by an older infant or toddler. Moreover, in accordance with the present invention a parent employing a prior art nipple and holder (FIGS. 1 and 2) to nurse a small infant can continue to use the same holder when the child reaches the older infant and toddler stages of development and accidental dislodgment of the nipple is more likely to occur, simply by inserting the adaptor ring described above into the groove 22 to holder 10 and employing the nipple 61 of the invention along with retainer 50 to replace the previously used nipple. This eliminates the need to replace the entire nursing unit.

A nursing unit in accordance with this invention may also include a cap 74 which is of a size to fit securely over the raised undercut lip 56 of retainer 50 and thus, being securely force fitted thereon, protecting the entire, surface of the nipple 61, including teat-like protuberance 62. In this respect, cap 74 is provided with a downwardly depending, centrally located internal skirt 75 adapted to cover the teat-like protuberance and prevent leakage through the protuberance and at the same time prevent soiling and damage thereof when the unit is not in use. Cap 74 can, when removed from the threaded nipple retainer, simply be fitted onto the bottom of holder 10, thus sealing the same. This minimizes the possibility of misplacement thereof and prevents a nursing infant from inserting his fingers or hands inside the open bottom of the holder. This prevents possible rupture of the sac and provides a solid base for purposes of resting the nursing unit when it is not being used to nurse an infant or when the unit is being stored for future use.

As illustrated in FIGS. 3 and 4 an open marginal edge 76 of collapsible liquid-retention sac 36 is turned outwardly and downwardly over rim 20, thereby becoming engaged between the internal threaded surface of nipple retainer 50 and the external threaded surface of split adaptor ring 38. Moreover, marginal edge 76 is gripped rightly between threads 54 of retainer 50 and threads 42 of ring 38 as shown more particularly in FIG. 4 when the unit is in assembled form. Therefore, the chances of any leakage of the contents in sac 36 is substantially completely eliminated. It is this combination of the tight fit of the marginal edge 76, as well as the tight fit of nipple 61 between the rim 20 and lip 56 which locks both sac 36 and nipple 61 in place during use which seals the entire open end of the unit against leakage and at the same time substantially completely prevents accidental or inadvertent removal of the nipple.

As previously mentioned, shoulder 28 and rim 30 contain at least one and preferably a plurality of discontinuities 48 and 49. The discontinuities are of sufficient width to permit a portion of one's finger or thumb to engage the depending tabs 44 and 45 of ring 38 and remove the ring from the groove 22 of holder 10 while at the same time being sufficiently wide also to permit the tabs to fit therein.

From the above, it will be obvious to those skilled in the art that the materials of construction and precise manner of fabrication of any of the parts of the nursing assembly described herein are not critical. The nipple and collapsible sac should, of course, be flexible, liquid impermeable and somewhat elastic. Plastic film is generally preferred for the disposable collapsible sac since it can be compounded in a manner such that it will possess each of the above properties and also because it can be fabricated into bags or sacs easily and inexpensively through the use of heat sealing. The bags can be joined in the form of a sheet or long strip and can be rolled, if desired, to provide for easy dispensing as generally shown in the above-mentioned Boynton et al. patent.

The nursing holder is preferably formed of a moldable plastic which may be either a thermoforming or thermosetting material. Through use of such a material, the various rims, grooves, slots, etc., can be integrally formed into the holder in a single molding operation.

Numerous modifications and variations of this invention may be made without departing from the spirit and scope thereof. It is to be understood, therefore, that this invention is not to be limited to the embodiments disclosed herein except as defined in the appendant claims.

What is claimed is:

1. A nursing unit system comprising:

a generally elongated, hollow nursing holder, said nursing holder having an open nipple receiving end, with an end rim at its upper terminus, annular groove proximate said end rim, and a radially extending abutment shoulder at the lower extent of said annular groove, a first nipple including a teat-like protuberance, an aerola portion, and a breast-like portion, said first nipple adapted to snap over holder end, and having a depending annular skirt with an internal annular groove, said depending annular skirt being of an appropriate width and depth for complementary engagement within the annual groove of said holder with the internal annular groove of said nipple skirt engaging the end rim of said holder, the improvement comprising holder conversion means to selectively permit the nipple receiving end of the holder to accommodate a second nipple, said second nipple type including a teat-like protuberance, an areola portion and a breast-like portion, said second nipple adapted to be fastened to said holder end by a threaded nipple retainer, said second nipple having a bottom flange for placement on the holder end rim and an intermediate external annular groove for secure engagement with said threaded nipple retainer, said threaded nipple retainer including a depending annular skirt for overlying said annular groove of the holder, and having internal threads extending across said annular groove, said holder conversion means including a removable threaded adaptor ring for insertion into said annular groove, to switch said holder from a first to a second condition, said threaded adaptor ring having an external thread complementary to the internal thread of said nipple retainer, said first condition characterized by said threaded adaptor ring being removed from the nurser unit and said first nipple being frictionally secured to said holder, said second condition characterized by said threaded adaptor ring being located within the holder annular groove, said second nipple being secured to said threaded nipple retainer, and the internal threads of said nipple retainer being in engagement with the external threads of said threaded adaptor ring.

2. The nursing unit of claim 1, wherein:

said radially extending abutment shoulder of the holder includes at least one discontinuity, said discontinuity being of an appropriate size to receive an adult's finger to provide means to disengage said first nipple from said holder when said holder is in said first condition, said threaded adaptor ring having a split, and at least one depending tab for location within said discontinuity when said nurser holder is converted to said second condition.

3. The nursing unit of claim 2, wherein said split passes through said depending tab.

4. The nursing unit of claim 2, wherein said holder includes a pair of diametrically opposed discontinuities said threaded adaptor ring includes a pair of diametrically opposed tabs for insertion within said discontinuities, and said split passes through one of said pair of tabs.

5. The nursing unit of claim 1, further including a collapsible liquid-retention sac having a closed end within the hollow portion of said holder and an open end folded outwardly and downwardly over said end rim of said holder said nurser sac open end extending across the annular groove of said holder, said skirt of said first nipple securing said folded over sac portion within said annular groove when said holder is in said first condition, and said depending annular skirt of said threaded nipple retainer securing said folded over sac portion across said annular groove when said holder is in said second condition.

6. In a nursing unit provided with a generally elongated, hollow nursing holder, a collapsible liquid-retention sac having a closed end within the hollow portion of said holder and an open end extending therefrom, a nipple including a teat-like protuberance, and said nursing holder having an open sac and nipple receiving end and an annular groove proximate to said open sac and nipple receiving end defining a peripheral sac and nipple holding rim on the side of said groove closest to said open sac and nipple receiving end and further defining a discontinuous abutment shoulder on the opposite side of said groove, and said liquid-retention sac having an upper marginal portion folded outwardly and downwardly over said rim, the improvement comprising a split, threaded adaptor ring provided with at least one depending tab located in said annular groove and extending circumferentially around said nursing holder, the depending tab thereof being disposed within a discontinuity of said shoulder, said upper marginal portion of said liquid-retention sac being folded outwardly and downwardly over said split, threaded adaptor ring, a threaded nipple retainer disposed over said holder and cooperable with said split, threaded adaptor ring, said nipple being disposed in said threaded nipple retainer and secured against said rim thereby and said threaded nipple retainer cooperating with said split, threaded adaptor ring to secure said marginal portion of said liquid-retention sac between the threads thereof and against said shoulder.

7. A nursing unit according to claim 6, wherein the abutment shoulder is discontinuous at a plurality of points and the split, threaded adaptor ring is provided with a plurality of depending tabs equal in number to said plurality of points.

8. A nursing unit according to claim 6, wherein the split, threaded adaptor ring is split through one depending tab, thereby being separable for insertion in the annular groove.

9. In a nursing unit provided with a generally elongated, hollow nursing holder, a collapsible liquid-retention sac having a closed end within the hollow portion of said holder and an open end extending therefrom, a nipple including a teat-like protuberance, and said receiving holder having an open sac and nipple receiving end and an annular groove proximate to said open sac and nipple receiving end defining a peripheral sac and nipple holding rim on the side of said groove closest to said open sac and nipple receiving end and further defining a discontinuous abutment shoulder on the opposite side of said groove, and said liquid-retention sac having an upper marginal portion folded outwardly and downwardly over said rim, the improvement comprising a split, threaded adaptor ring provided with at least one depending tab located in said annular groove and extending circumferentially around said nursing holder, the depending tab thereof being disposed within a discontinuity of said shoulder, said upper marginal portion of said liquid-retention sac being folded outwardly and downwardly over said split, threaded adaptor ring, a threaded nipple retainer disposed over said holder and cooperable with said split, threaded adaptor ring, said threaded nipple retainer having an upwardly and inwardly extending circumferential lip which forms a central nipple receiving opening, the teat-like protuberance of said nipple terminating in an areola portion connected to a breast-like portion having an external groove defining a continuous peripheral shoulder on the side of said groove farthest away from said teat-like protuberance and further defining another continuous shoulder on the side of said groove nearest said teat-like protuberance, the circumferential lip of said threaded nipple retainer extending circumferentially in said annular groove of said breast-like portion of said nipple and around said nipple, the upper side of said continuous peripheral shoulder on the side of said groove farthest away from said teat-like protuberance lying against the lower side of said lip and the lower side of said shoulder lying against said rim, the lower side of said continuous peripheral shoulder on the side of said groove nearest said teat-like protuberance lying against the upper side of said lip and said nipple being secured against said rim by said threaded nipple retainer and said threaded nipple retainer cooperating with said split, threaded adaptor ring to secure said marginal portion of said liquid-retention sac between the threads thereof and against said abutment shoulder.

10. A nursing unit according to claim 9, wherein the abutment shoulder is discontinuous at a plurality of points and the split, threaded adaptor ring is provided with a plurality of depending tabs equal in number to said plurality of points.

11. A nursing unit according to claim 9, wherein the split, threaded adaptor ring is split through one depending tab, thereby being separable for insertion in the annular groove.

12. An adaptor ring comprising a generally flexible, circular body having at least one depending tab thereon extending downwardly from said body and a plurality of threads disposed on the exterior surface of said body, said ring being split and discontinuous on a line extending through said body and said tab, thereby permitting said ring to be opened and disposed around a suitably shaped support.

13. An adaptor ring according to claim 12 having a plurality of depending tabs thereon and being split and discontinuous on a line extending through said body and only one of said tabs.

* * * * *